US009353443B2

(12) United States Patent
Milum et al.

(10) Patent No.: US 9,353,443 B2
(45) Date of Patent: May 31, 2016

(54) STABLE CATALYSTS FOR ELECTROLESS METALLIZATION

(75) Inventors: Kristen M. Milum, Shrewsbury, MA (US); Donald E. Cleary, Littleton, MA (US); Maria Anna Rzeznik, Shrewsbury, MA (US)

(73) Assignee: Rohm and Haas Electronic Materials LLC

( * ) Notice: Subject to any disclaimer, the term of this patent is extended or adjusted under 35 U.S.C. 154(b) by 557 days.

(21) Appl. No.: 13/589,007

(22) Filed: Aug. 17, 2012

(65) Prior Publication Data

US 2013/0230657 A1 Sep. 5, 2013

Related U.S. Application Data

(60) Provisional application No. 61/524,411, filed on Aug. 17, 2011.

(51) Int. Cl.

| | |
|---|---|
| ***C23C 18/22*** | (2006.01) |
| ***C23C 18/30*** | (2006.01) |
| ***C23C 18/16*** | (2006.01) |
| ***C23C 18/20*** | (2006.01) |
| ***C23C 18/31*** | (2006.01) |
| ***C23C 18/38*** | (2006.01) |
| ***C23C 18/32*** | (2006.01) |

(52) U.S. Cl.

CPC ..... *C23C 18/1662* (2013.01); *C23C 18/206* (2013.01); *C23C 18/2073* (2013.01); *C23C 18/2086* (2013.01); *C23C 18/30* (2013.01); *C23C 18/31* (2013.01); *C23C 18/32* (2013.01); *C23C 18/38* (2013.01)

(58) Field of Classification Search

CPC ..... C23C 18/1662

See application file for complete search history.

(56) References Cited

U.S. PATENT DOCUMENTS

| | | | | |
|---|---|---|---|---|
| 4,004,051 | A | 1/1977 | Lee | |
| 4,725,314 | A | 2/1988 | Gulla | |
| 4,863,758 | A * | 9/1989 | Rhodenizer | 427/98.1 |
| 5,880,228 | A * | 3/1999 | Marten | 525/524 |
| 6,183,545 | B1 * | 2/2001 | Okuhama | C22B 3/0051 106/1.18 |
| 2002/0197404 | A1 | 12/2002 | Lee et al. | |
| 2004/0043153 | A1 * | 3/2004 | Okuhama et al. | 427/307 |
| 2005/0189520 | A1 * | 9/2005 | Okada et al. | 252/500 |
| 2005/0258134 | A1 * | 11/2005 | Okuhama | C23C 18/30 216/13 |

FOREIGN PATENT DOCUMENTS

| | | | |
|---|---|---|---|
| EP | 0187962 | A2 | 7/1986 |
| JP | 2003268558 | | 9/2003 |
| JP | 4632301 | B2 | 8/2006 |
| JP | 2008214691 | | 9/2008 |
| JP | 2008266712 | A | 11/2008 |

(Continued)

OTHER PUBLICATIONS

"Sol" definition, The Free Dictionary, 4 pages, retrieved Jan. 31, 2015.*

(Continued)

*Primary Examiner* — Katherine A Bareford

(74) *Attorney, Agent, or Firm* — John J. Piskorski

(57) ABSTRACT

Catalysts include nanoparticles of catalytic metal and gallic acid or gallic acid derivatives or salts thereof. The catalysts are used in electroless metal plating. The catalysts are free of tin.

11 Claims, 2 Drawing Sheets

(56) References Cited

FOREIGN PATENT DOCUMENTS

| | | |
|---|---|---|
| JP | 2009091621 | 4/2009 |
| JP | 2009221505 | 10/2009 |
| JP | 2011032509 | 2/2011 |
| JP | 2011038128 | 2/2011 |

OTHER PUBLICATIONS

"Colloidal" definition, The Free Dictionary, 2 pages, retrieved Jan. 31, 2015.*

Hawley's Condensed Chemical Dictionary, Twelfth Edition, Van Nostrand Reinhold, 1993, p. 981.*

European Search Report for corresponding European Application No. 12 18 0785, Dec. 2012.

* cited by examiner

STABLE CATALYSTS FOR ELECTROLESS METALLIZATION

This application claims the benefit of priority under 35 U.S.C. §119(e) to U.S. Provisional Application No. 61/524,411, filed Aug. 17, 2011, the entire contents of which application are incorporated herein by reference.

FIELD OF THE INVENTION

The present invention is directed to stable aqueous catalysts for electroless metallization. More specifically, the present invention is directed to stable aqueous catalysts for electroless metallization which are tin free and are stabilized by gallic acid, gallic acid derivatives and salts thereof.

BACKGROUND OF THE INVENTION

Electroless metal deposition is a well-known process for depositing metallic layers on substrate surfaces. Electroless plating of a dielectric surface requires the prior application of a catalyst. The most commonly used method of catalyzing or activating dielectrics, such as non-conductive sections of laminated substrates used in the manufacture of printed circuit boards, is to treat the substrate with an aqueous tin/palladium colloid in an acidic chloride medium. The structure of the colloid has been extensively studied. In general, the colloid includes a palladium metal core surrounded by a stabilizing layer of tin(II) ions, essentially a shell of $SnCl_3^-$ complexes which act as surface stabilizing groups to avoid agglomeration of the colloids in suspension.

In the activation process the tin/palladium colloid catalyst is adsorbed onto a dielectric substrate, such as epoxy or polyimide containing substrate, to activate electroless metal deposition. Theoretically the catalyst functions as a carrier in the path of electron transfer from reducing agents to metal ions in the electroless metal plating bath. Although performance of electroless plating is influenced by many factors, such as additive composition of the plating solution, the activation step is key for controlling the rate and mechanism of electroless plating.

In recent years, along with the reduction in size and desired increase in the performance of electronic devices, the demand for defect free electronic circuits in the electronic packaging industry has become higher. Although the tin/palladium colloid has been commercially used as an activator for electroless metal plating for decades and has given acceptable service, it has many disadvantages which are becoming more pronounced as the demand for higher quality electronic devices increases. The stability of the tin/palladium colloid is a major concern. As mentioned above the tin/palladium colloid is stabilized by a layer of tin(II) ions and its counter anions can prevent palladium from agglomerating. The catalyst is sensitive to air and readily oxidizes to tin(IV), thus the colloid cannot maintain its colloidal structure. This oxidation is further promoted by increase in temperature and agitation during electroless plating. If the concentration of tin(II) falls to critical levels, such as close to zero, palladium metal particles grow in size, agglomerate and precipitate, thus becoming catalytically inactive. As a result there is an increase in demand for a more stable catalyst. In addition the high and fluctuating cost of palladium has encouraged the industry to search for a less costly metal.

Considerable efforts have been made to find new and improved catalysts. Because of the high cost of palladium, much effort has been directed toward development of palladium free catalysts, such as colloidal silver catalysts. Another direction that research has taken is towards a tin free palladium catalyst since stannous chloride is costly and the oxidized tin requires a separate acceleration step. In addition to adding a further step in the overall electroless process, materials used in the acceleration step often strip the catalyst from the substrate to be plated leaving undesirable voids in the plating. This is especially common on glass fiber substrates which are typically used in printed circuit board manufacturing. However, such tin free catalysts have shown to be insufficiently active and reliable for through-hole plating in printed circuit board manufacture. Further, such catalysts typically become progressively less active upon storage, thus rendering such catalysts unreliable and impractical for commercial use.

Alternative stabilizing moieties for tin complexes, such as polyvinylpyrrolidone (PVP) and dendrimers, have been investigated. Stable and uniform PVP protected nanoparticles have been reported by various research groups in the literature. Other metal colloids, such as silver/palladium and copper/palladium in which palladium is partially replaced by less expensive metals have also been reported in the literature; however, to date there has been no commercially acceptable alternative for the tin/palladium colloidal catalyst. Accordingly, there is still a need for a stable and reliable electroless metal plating catalyst.

SUMMARY OF THE INVENTION

Methods include: a) providing a substrate; b) applying an aqueous catalyst solution to the substrate, the aqueous catalyst solution includes nanoparticles of one or more metal chosen from silver, gold, platinum, palladium, iridium, copper, aluminum, cobalt, nickel and iron, and one or more compounds chosen from gallic acid, gallic acid derivatives and salts thereof, the catalyst is free of tin; and c) electrolessly depositing metal onto the substrate using an electroless metal plating bath.

The catalysts may be used to electrolessly plate metals on substrates, including substrates of dielectric materials and are stable upon storage as well as during electroless metal plating since they do not readily oxidize as compared to conventional tin/palladium catalysts. The catalysts are biodegradable, thus they do not present an environmental hazard. The gallic acid, gallic acid derivatives and salts thereof function as stabilizers as stannous chloride does in the conventional tin/palladium catalyst except that the gallic acid, gallic acid derivatives and salts thereof do not present the environmental hazards of stannous chloride upon disposal. The gallic acid, gallic acid derivatives and salts thereof also function as a reducing agent in nanoparticle formation and as an antioxidant to improve catalyst lifetime. The gallic acid, gallic acid derivative and salts thereof stabilized metal catalysts enable electroless metal plating without an acceleration step and enable metal plating of the substrate, even walls of through-holes of printed circuit boards.

DETAILED DESCRIPTION OF THE INVENTION

Figure 1:
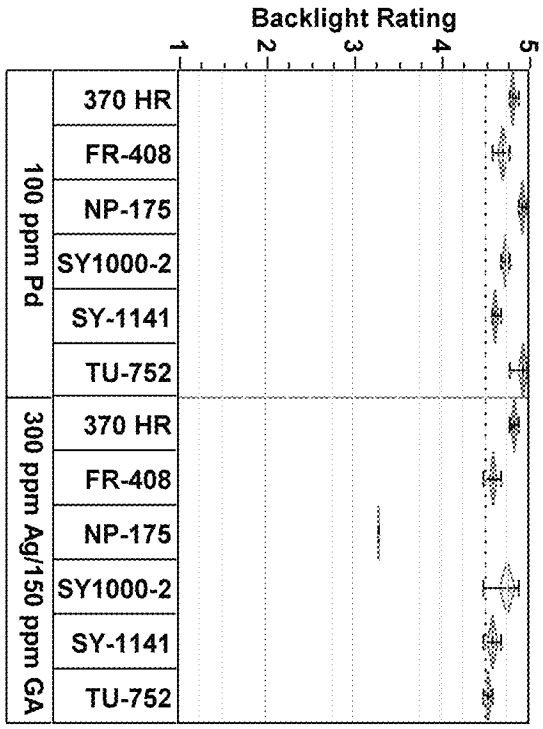
FIG. 1 is a backlight rating of a 300 ppm Ag/150 ppm gallic acid stabilized catalyst vs. a conventional tin/palladium catalyst.

As used throughout this specification, the abbreviations given below have the following meanings, unless the context clearly indicates otherwise: g=gram; mg=milligram; ml=milliliter; L=liter; cm=centimeter; m=meter; mm=millimeter; μm=micron; nm=nanometers; ppm=parts per million; ° C.=degrees Centigrade; g/L=grams per liter; DI=deionized; wt %=percent by weight; and $T_g$=glass transition temperature.

The terms "printed circuit board" and "printed wiring board" are used interchangeably throughout this specification. The terms "plating" and "deposition" are used interchangeably throughout this specification. All amounts are percent by weight, unless otherwise noted. All numerical ranges are inclusive and combinable in any order except where it is logical that such numerical ranges are constrained to add up to 100%.

Aqueous catalyst solutions include nanoparticles of metal chosen from silver, gold, platinum, palladium, iridium, copper, aluminum, cobalt, nickel and iron, and one or more stabilizing compounds chosen from gallic acid, gallic acid derivatives and salts thereof. Preferably the metals are chosen from silver, palladium and gold, more preferably the metals are chosen from silver and palladium, most preferably the metal is silver. Preferably, the stabilizing compounds have a general formula:

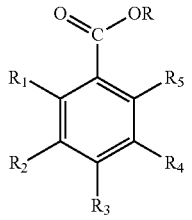

wherein R is —H or —$(CH_2)_x$—$CH_3$ and x is an integer from 2-4 and $R_1$, $R_2$, $R_3$, $R_4$ and $R_5$ are —H or —OH and are the same or different with the proviso that at least one or $R_1$, $R_2$, $R_3$, $R_4$ and $R_5$ is —OH, preferably R is —H, more preferably, R is —H and $R_2$, $R_3$ and $R_4$ are —OH. Exemplary compounds include gallic acid, dihydroxybenzoic acid, hydroxybenzoic acid, 2,4,6-trihydroxybenzoic acid and gallic acid esters, such as propyl gallate. Typically, the salts are sodium or potassium salts. The preferred compound is gallic acid.

The stabilizing compounds are included in the aqueous catalyst in sufficient amounts to provide the desired stabilization and metal plating. Minor experimentation may be done to achieve the amount of a particular stabilizer or combination of stabilizers to stabilize a catalyst and metal plate. In general, one or more stabilizing compounds are included in the aqueous catalyst in amounts of 50 ppm to 1000 ppm, preferably from 100 ppm to 500 ppm.

Optionally, one or more reducing agents may be included in addition to gallic acid or gallic acid derivative to reduce metal ions to metal. Conventional reducing agents known to reduce metal ions to metal may be used. Such reducing agents include, but are not limited to, dimethylamine borane, sodium borohydride, ascorbic acid, iso-ascorbic acid, sodium hypophosphite, hydrazine hydrate, formic acid and formaldehyde. Reducing agents are included in amounts to reduce substantially all of the metal ions to metal. Such amounts are generally conventional amounts and are well known by those of skill in the art.

Sources of metals include any of the conventional water soluble metal salts known in the art and literature which provide metals having catalytic activity. Mixtures of two or more catalytic metals may be used. Such salts are included to provide metal in amounts of 100 ppm to 2000 ppm, preferably from 300 ppm to 1500 ppm. Silver salts include, but are not limited to, silver nitrate, silver acetate, silver trifluoroacetate, silver tosylate, silver triflate, silver fluoride, silver oxide, silver sodium thiosulfate and silver potassium cyanide. Palladium salts include, but are not limited to, palladium chloride, palladium acetate, palladium potassium chloride, palladium sodium chloride and palladium nitrate. Gold salts include, but are not limited to gold cyanide, gold trichloride, gold tribromide, potassium gold chloride, potassium gold cyanide, sodium gold chloride and sodium gold cyanide. Platinum salts include, but are not limited to, platinum chloride and platinum sulfate. Iridium salts include, but are not limited to, iridium tribromide and iridium potassium chloride. Copper salts include, but are not limited to, copper sulfate and copper chloride. Nickel salts include, but are not limited to nickel chloride and nickel sulfate. Cobalt salts include, but are not limited to, cobalt acetate, cobalt chloride, cobalt bromide and cobalt ammonium sulfate. Aluminum salts include, but are not limited to, aluminum sulfate and aluminum sodium sulfate. Iron salts include, but are not limited to, ferrous ammonium citrate, ferrous ammonium oxalate and ferrous ammonium sulfate. Typically the metal salts are silver, palladium and gold. Preferably the metal salts are silver and palladium. More preferably the salts are silver.

The components which make up the aqueous catalyst may be combined in any order. Any suitable method known in the art and literature may be used to prepare the aqueous catalyst. While the specific parameters and amounts of components may vary from one method to the other, in general, one or more of the stabilizing compounds is first solubilized in a sufficient amount of water. One or more sources of metal as an aqueous solution are combined with the stabilizer solution with vigorous agitation to form a uniform mixture. Optionally, an aqueous solution containing one or more reducing agents may then be mixed with the mixture of stabilizers and metal salts with vigorous agitation. The process steps and solution are typically done at room temperature; however, temperatures may be varied to assist in solubilizing reaction components and to encourage reduction of metal ions. While not being bound by theory, the stabilizers may coat or surround portions or most of the metal to stabilize the catalyst solution. The diameters of the particles of metal and stabilizer are range in size from at least 1 nm, typically from 1 nm to 1000 nm or such as from 2 nm to 500 nm Preferably the particles range in size from 2 nm to 300 nm, more preferably from 2 nm to 100 nm and most preferably from 2 nm to 10 nm.

The pH of the as-synthesized catalyst may range from acidic to mildly alkaline. If the catalyst is alkaline, prior to using the catalyst for electroless metallization, the pH is reduced to below 7. One or more acids or salts thereof may be added to the catalyst to provide a pH range of less than 7, preferably from 1-6.5, more preferably from 2-6. Inorganic or organic acids or salts thereof may be used in sufficient amounts to maintain the pH at the desired range. Mixtures of inorganic and organic acids and salts also may be used. Examples of inorganic acids are hydrochloric acid, sulfuric acid and nitric acid. Organic acids include mono- and polycarboxylic acids, such as dicarboxylic acids. Examples of organic acids are benzoic acid, ascorbic acid, iso-ascorbic acid, malic acid, maleic acid, oxalic acid, acetic acid, citric acid and tartaric acid.

The catalysts may be used to electrolessly metal plate various substrates. Such substrates include, but are not limited to, materials including inorganic and organic substances such as glass, ceramics, porcelain, resins, paper, cloth and combinations thereof. Metal-clad and unclad materials also are substrates which may be metal plated using the catalyst.

Substrates also include printed circuit boards. Such printed circuit boards include metal-clad and unclad with thermosetting resins, thermoplastic resins and combinations thereof, including fiber, such as fiberglass, and impregnated embodiments of the foregoing.

Thermoplastic resins include, but are not limited to, acetal resins, acrylics, such as methyl acrylate, cellulosic resins, such as ethyl acetate, cellulose propionate, cellulose acetate butyrate and cellulose nitrate, polyethers, nylon, polyethylene, polystyrene, styrene blends, such as acrylonitrile styrene and copolymers and acrylonitrile-butadiene styrene copolymers, polycarbonates, polychlorotrifluoroethylene, and vinylpolymers and copolymers, such as vinyl acetate, vinyl alcohol, vinyl butyral, vinyl chloride, vinyl chloride-acetate copolymer, vinylidene chloride and vinyl formal.

Thermosetting resins include, but are not limited to, allyl phthalate, furane, melamine-formaldehyde, phenol-formaldehyde and phenol-furfural copolymers, alone or compounded with butadiene acrylonitrile copolymers or acrylonitrile-butadiene-styrene copolymers, polyacrylic esters, silicones, urea formaldehydes, epoxy resins, allyl resins, glyceryl phthalates and polyesters.

Porous materials include, but are not limited to paper, wood, fiberglass, cloth and fibers, such as natural and synthetic fibers, such as cotton fibers and polyester fibers.

The catalysts may be used to plate both low and high $T_g$ resins. Low $T_g$ resins have a $T_g$ below 160° C. and high $T_g$ resins have a $T_g$ of 160° C. and above. Typically high $T_g$ resins have a $T_g$ of 160° C. to 280° C. or such as from 170° C. to 240° C. High $T_g$ polymer resins include, but are not limited to, polytetrafluoroethylene (PTFE) and polytetrafluoroethylene blends. Such blends include, for example, PTFE with polypheneylene oxides and cyanate esters. Other classes of polymer resins which include resins with a high Tg include, but are not limited to, epoxy resins, such as difunctional and multifunctional epoxy resins, bimaleimide/triazine and epoxy resins (BT epoxy), epoxy/polyphenylene oxide resins, acrylonitrile butadienestyrene, polycarbonates (PC), polyphenylene oxides (PPO), polypheneylene ethers (PPE), polyphenylene sulfides (PPS), polysulfones (PS), polyamides, polyesters such as polyethyleneterephthalate (PET) and polybutyleneterephthalate (PBT), polyetherketones (PEEK), liquid crystal polymers, polyurethanes, polyetherimides, epoxies and composites thereof.

The catalyst may be used to deposit metals on the walls of through-holes or vias of printed circuit boards. The catalysts may be used in both horizontal and vertical processes of manufacturing printed circuit boards.

The aqueous catalysts may be used with conventional electroless metal plating baths. While it is envisioned that the catalysts may be used to electrolessly deposit any metal which may be electrolessly plated, typically, the metal is chosen from copper, copper alloys, nickel or nickel alloys. More typically the metal is chosen from copper and copper alloys, most typically copper is used. An example of a commercially available electroless copper plating bath is CIRCUPOSIT™ 880 Electroless Copper bath (available from Rohm and Haas Electronic Materials, LLC, Marlborough, Mass.).

Typically sources of copper ions include, but are not limited to, water soluble halides, nitrates, acetates, sulfates and other organic and inorganic salts of copper. Mixtures of one or more of such copper salts may be used to provide copper ions. Examples include copper sulfate, such as copper sulfate pentahydrate, copper chloride, copper nitrate, copper hydroxide and copper sulfamate. Conventional amounts of copper salts may be used in the compositions. In general copper ion concentrations in the composition may range from 0.5 g/L to 30 g/L.

One or more alloying metals also may be included in the electroless compositions. Such alloying metals include, but are not limited to, nickel and tin. Examples of copper alloys include copper/nickel and copper/tin. Typically the copper alloy is copper/nickel.

Sources of nickel ions for nickel and nickel alloy electroless baths may include one or more conventional water soluble salts of nickel. Sources of nickel ions include, but are not limited to, nickel sulfates and nickel halides. Sources of nickel ions may be included in the electroless alloying compositions in conventional amounts. Typically sources of nickel ions are included in amounts of 0.5 g/L to 10 g/L.

The method steps used in metalizing a substrate may vary depending on whether the surface to be plated is metal or dielectric. Specific steps and sequence of steps may also vary from one method to the next. Conventional steps used for electrolessly metal plating a substrate may be used with the catalysts; however, the aqueous gallic acid and gallic acid stabilized metal catalysts do not require an acceleration step as in many conventional electroless plating processes. Accordingly, acceleration steps are preferably excluded when using the catalyst. In general, the catalyst is applied to the surface of the substrate to be electrolessly plated with a metal followed by application of the metal plating bath. Electroless metal plating parameters, such as temperature and time may be conventional. Conventional substrate preparation methods, such as cleaning or degreasing the substrate surface, roughening or micro-roughening the surface, etching or micro-etching the surface, solvent swell applications, desmearing through-holes and various rinse and anti-tarnish treatments may be used. Such methods and formulations are well known in the art and disclosed in the literature.

Typically, when the substrate to be metal plated is a dielectric material such as on the surface of a printed circuit board or on the walls of through-holes, the boards are rinsed with water and cleaned and degreased followed by desmearing the through-hole walls. Typically prepping or softening the dielectric surface or desmearing of the through-holes begins with application of a solvent swell.

Any conventional solvent swell may be used. The specific type may vary depending on the type of dielectric material. Examples of dielectrics are disclosed above. Minor experimentation may be done to determine which solvent swell is suitable for a particular dielectric material. The $T_g$ of the dielectric often determines the type of solvent swell to be used. Solvent swells include, but are not limited to, glycol ethers and their associated ether acetates. Conventional amounts of glycol ethers and their associated ether acetates may be used. Examples of commercially available solvent swells are CIRCUPOSIT™ Conditioner 3302, CIRCUPOSIT™ Hole Prep 3303 and CIRCUPOSIT™ Hole Prep 4120 (available from Rohm and Haas Electronic Materials).

Optionally, the substrate and through-holes are rinsed with water. A promoter is then applied. Conventional promoters may be used. Such promoters include sulfuric acid, chromic acid, alkaline permanganate or plasma etching. Typically alkaline permanganate is used as the promoter. An example of a commercially available promoter is CIRCUPOSIT™ Promoter 4130 and CIRCUPOSIT™ MLB Promoter 3308 (available from Rohm and Haas Electronic Materials).

Optionally, the substrate and through-holes are rinsed again with water. A neutralizer is then applied to neutralize any residues left by the promoter. Conventional neutralizers may be used. Typically the neutralizer is an aqueous alkaline solution containing one or more amines or a solution of 3 wt % peroxide and 3 wt % sulfuric acid. An example of a commercially available neutralizer is CIRCUPOSIT™ MLB Neutralizer 216-5. Optionally, the substrate and through-holes are rinsed with water and then dried.

After the solvent swelling and desmearing an acid or alkaline conditioner may be applied. Conventional conditioners may be used. Such conditioners may include one or more cationic surfactants, non-ionic surfactants, complexing agents and pH adjusters or buffers. Examples of commercially available acid conditioners are CIRCUPOSIT™ Conditioner 3320 and CIRCUPOSIT™ Conditioner 3327 (available from Rohm and Haas Electronic Materials). Suitable alkaline conditioners include, but are not limited to, aqueous alkaline surfactant solutions containing one or more quaternary amines and polyamines. Examples of commercially available alkaline surfactants are CIRCUPOSIT™ Conditioner 231, 3325, 813 and 860. Optionally, the substrate and through-holes are rinsed with water.

Conditioning may be followed by micro-etching. Conventional micro-etching compositions may be used. Micro-etching is designed to provide a micro-roughened metal surface on exposed metal (e.g. innerlayers and surface etch) to enhance subsequent adhesion of deposited electroless and later electroplate. Micro-etches include, but are not limited to, 60 g/L to 120 g/L sodium persulfate or sodium or potassium oxymonopersulfate and sulfuric acid (2%) mixture, or generic sulfuric acid/hydrogen peroxide. Examples of commercially available micro-etching compositions are CIRCUPOSIT™ Microetch 3330 and PREPOSIT™ 748. Optionally, the substrate is rinsed with water.

A pre-dip may then applied to the micro-etched substrate and through-holes. Examples of pre-dips include 2% to 5% hydrochloric acid or an acidic solution of 25 g/L to 75 g/L sodium chloride. A commercially available pre-dip is CATAPREP™ 404 (available from Rohm and Haas Electronic Materials).

A stabilized gallic acid or gallic acid derivative or salts thereof catalyst is then applied to the substrate and through-holes. Priming with the catalyst may be done for 1-10 minutes, typically from 2-8 minutes. Temperatures may range from room temperature to 80° C., or such as from 30° C. to 60° C. The substrate and through-holes optionally may be rinsed with water after application of the catalyst.

The substrate and walls of the through-holes are then plated with metal, such as copper, copper alloy, nickel or nickel alloy with an electroless bath. Typically copper is plated on the walls of the through-holes. Plating times and temperatures may be conventional. Typically metal deposition is done at temperatures of 20° C. to 80°, more typically from 30° C. to 60° C. The substrate may be immersed in the electroless plating bath or the electroless may be sprayed onto the substrate. Typically, deposition may be done for 5 seconds to 30 minutes; however, plating times may vary depending on the thickness of the metal on the substrate.

Optionally anti-tarnish may be applied to the metal. Conventional anti-tarnish compositions may be used. An example of anti-tarnish is ANTI TARNISH™ 7130 (obtainable from Rohm and Haas Electronic Materials). The substrate may optionally be rinsed and then the boards may be dried.

Further processing may include conventional processing by photoimaging and further metal deposition on the substrates such as electrolytic metal deposition of, for example, copper, copper alloys, tin and tin alloys.

The catalysts may be used to electrolessly plate metals on substrates, including substrates of dielectric materials and are stable upon storage, and during electroless metal plating since they do not readily oxidize as compared to conventional tin/palladium catalysts. The catalysts are biodegradable, thus they do not present an environmental hazard. The gallic acid, gallic acid derivatives and salts thereof function as a stabilizer as stannous chloride does in the conventional tin/palladium catalyst except that the gallic acid gallic acid derivatives and salts thereof do not present the environmental hazards of stannous chloride upon disposal. The gallic acid, gallic acid derivatives and salts thereof also function as a reducing agent in nanoparticle formation and as an antioxidant to improve catalyst lifetime. The gallic acid, gallic acid derivatives and salts thereof stabilized metal catalysts enable electroless metal plating without an acceleration step and enable metal plating of the substrate, even walls of through-holes of printed circuit boards.

The following examples are not intended to limit the scope of the invention but are intended to further illustrate it.

Example 1

Two each of six different laminates with a plurality of through-holes were provided: NP-175, 370 HR, TUC-752, SY-1141, SY-1000-2, and FR-408. The NP-175 was obtained from Nanya. The 370 HR and FR4-408 were obtained from Isola. TUC-752 was obtained from Taiwan Union Technology, and SY-1141 and SY-1000-2 were obtained from Shengyi. The $T_g$ values of the laminates ranged from 140° C. to 180° C. Each laminate was 5 cm×12 cm. The through-holes of each laminate were treated as follows:

1. The through-holes of each laminate were desmeared with CIRCUPOSIT™ MLB Conditioner 211 for 7 minutes at 78° C.;
2. The through-holes of each laminate were then rinsed with flowing tap water for 4 minutes;
3. The through-holes were then treated with CIRCUPOSIT™ MLB Promoter 213 aqueous permanganate solution at a pH of 13 at 78° C. for 10 minutes;
4. The through-holes were then rinsed for 4 minutes in flowing tap water;
5. The through-holes were then treated with CIRCUPOSIT™ MLB Neutralizer 216-5 solution for 5 minutes at 46° C.;
6. The through-holes of each laminate were then rinsed with flowing tap water for 4 minutes;
7. The through-holes were then treated in an aqueous bath containing 3% CIRCUPOSIT™ Conditioner 231 alkaline conditioner for 5 minutes at 40° C.;
8. The through-holes of each laminate were then rinsed with flowing tap water for 4 minutes;
9. The through-holes were then treated with PREPOST™ 748 for 2 minutes at room temperature;
10. The through-holes of each laminate were then rinsed with flowing tap water for 4 minutes;
11. Through-holes of six of the laminates were then primed for 5 minutes at 40° C. with a 300 ppm silver catalyst from silver nitrate stabilized with 150 ppm of gallic acid at pH of 2.9 with catalyst particle sizes ranging from 7-10 nm while the through-holes of the other six laminates were treated with CATAPREP™ 404 hole preparation formulation for 1 minute at room temperature followed by a conventional colloidal palladium/tin catalyst containing 100 ppm of palladium with an excess of stannous chloride for 5 minutes at 40° C.;
12. The through-holes were then rinsed with flowing tap water for 4 minutes;
13. The laminates were then immersed in CIRCUPOSIT™ 880 electroless copper plating bath at 38° C. and at a pH of 13 and copper was deposited on the walls of the through-holes for 15 minutes;

14. The copper plated laminates were then rinsed with cold water for 4 minutes;

15. Each copper plated laminate was then dried with compressed air; and

16. The walls of the through-holes of the laminates were examined for copper plating coverage using the backlight process described below.

Each board was sectioned laterally to expose the copper plated walls of the through-holes. Ten lateral sections 1 mm thick were taken from the walls of the sectioned through-holes of each board to determine the through-hole wall coverage. The European Backlight Grading Scale was used. The 1 mm sections from each board were placed under a conventional optical microscope of 50× magnification. The quality of the copper deposits was determined by the amount of light that was observed under the microscope. If no light was observed the section was completely black and was rated a 5 on the backlight scale indicating complete copper coverage of the through-hole wall. If light passed through the entire section without any dark areas, this indicated that there was very little to no copper metal deposition on the wall and the section was rated 0. If sections had some dark regions as well as light regions, they were rated between 0 and 5.

FIG. 1 is a backlight rating distribution graph showing the backlight performance of both catalysts for each of the six types of boards plated. The diamond shaped figure in the graphs indicates the 95% confidence interval for the ten through-holes sections for each board. The horizontal line through the middle of each diamond indicates the average backlight value for each group of ten through-hole sections measured. With the exception of the NP-175 board treated with the silver/gallic acid catalyst, the silver/gallic acid catalyst performed substantially the same as the conventional palladium/tin colloidal catalyst with backlight values of 4.5 and greater. Typically backlight values of 4.5 and greater are indicative of commercially acceptable catalysts in the plating industry.

Example 2

Figure 2:
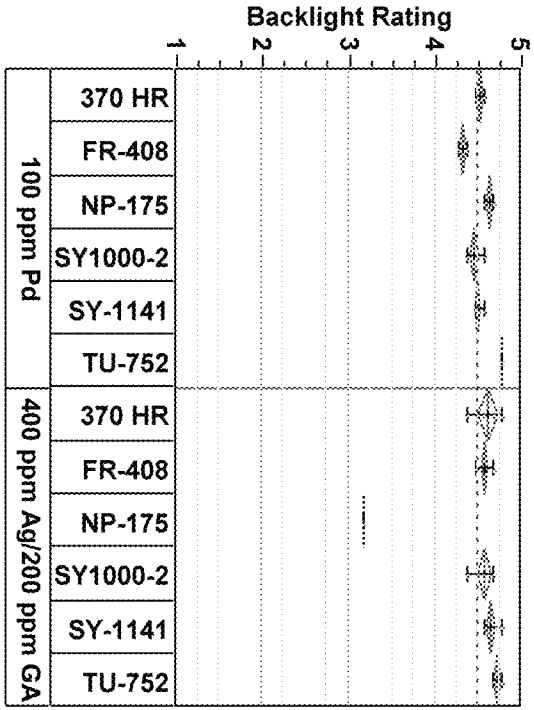
FIG. 2 is a backlight rating of a 400 ppm Ag/200 ppm gallic acid stabilized catalyst vs. a conventional tin/palladium catalyst.

The method of Example 1 was repeated except that the silver/gallic acid catalyst included 400 ppm of silver from silver acetate, 200 ppm of gallic acid and oxalic acid as a pH adjuster. The pH was 2.7 and the silver/gallic acid nanoparticles ranged in size from 7-10 nm. In addition, the laminates had dwell times in the catalyst of 7 minutes at 45° C. and the plating time was 20 minutes at 40° C. DI water instead of tap water was used to rinse the laminates before and after the catalyst step. The back light results are shown in FIG. 2.

The backlight results of all of the silver/gallic acid catalyst were substantially above the 4.5 mark with the exception of the NP-175 laminate which was at the same level as in Example 1. In contrast, the backlight plating results of the conventional palladium/tin colloidal catalyst were predominantly on the 4.5 border line with the results on the FR-408 laminate around 4.3 and below the acceptable range. Overall, the silver/gallic acid catalyst had better plating results than the conventional catalyst.

What is claimed is:

1. A method comprising:

a) providing a substrate;

b) applying a conditioner to the substrate; and then c) micro-etching the substrate; and then d) applying an aqueous catalyst solution to the substrate, the aqueous catalyst solution consists of nanoparticles of one or more metals selected from the group consisting of silver, gold, platinum, palladium, iridium, copper, aluminum, cobalt and nickel, and one or more stabilizing compounds selected from the group consisting of gallic acid, gallic acid salts, gallic acid esters, 2,4,6-trihydroxybenzoic acid and mixtures thereof in amounts of 50 ppm to 500 ppm, water, optionally one or more reducing agents selected from the group consisting of dimethylamine borane, sodium borohydride, ascorbic acid, iso-ascorbic acid, sodium hypophosphite, hydrazine hydrate, formic acid and formaldehyde, and optionally one or more acids, the aqueous catalyst solution is free of tin; and e) electrolessly depositing metal onto the substrate comprising the aqueous catalyst solution using an electroless metal plating bath.

2. The method of claim 1, wherein the metal is chosen from silver and palladium.

3. The method of claim 1, wherein the electrolessly deposited metal is copper, copper alloy, nickel or nickel alloy.

4. The method of claim 1, wherein the nanoparticles are at least 1 nm in diameter.

5. The method of claim 1, wherein the one or more stabilizing compounds in the aqueous catalyst solution are in amounts of 100 ppm to 500 ppm.

6. The method of claim 1, wherein the aqueous catalyst solution has a pH<7.

7. The method of claim 6, wherein the pH is 1-6.5.

8. The method of claim 1, wherein the substrate is a printed circuit board, including a thermoplastic resin or a thermosetting resin.

9. The method of claim 8, wherein the substrate is a thermosetting resin.

10. The method of claim 9, wherein the thermosetting resin is epoxy resin.

11. The method of claim 1, wherein the substrate is a printed circuit board and comprises through-holes.

* * * * *